US005432036A

United States Patent [19]

Beach et al.

[11] Patent Number: 5,432,036

[45] Date of Patent: Jul. 11, 1995

[54] LIQUID ELECTROSTATIC TONERS WITH TERPOLYMER RESIN

[75] Inventors: Bradley L. Beach; Donald L. Elbert; Richard W. Holt; Ashok Murthy; Ajay K. Suthar, all of Lexington; Richard B. Watkins, Frankfort, all of Ky.

[73] Assignee: Lexmark International, Inc., Greenwich, Conn.

[21] Appl. No.: 232,982

[22] Filed: Apr. 25, 1994

[51] Int. Cl.[6] ..... G03G 9/13

[52] U.S. Cl. ..... 430/115; 430/114

[58] Field of Search ..... 430/114, 115

[56] References Cited

U.S. PATENT DOCUMENTS

| | | | |
|---|---|---|---|
| 3,668,127 | 6/1972 | Machida et al. . | |
| 3,890,240 | 6/1975 | Hochberg . | |
| 3,976,583 | 8/1976 | Herrmann et al. | 430/114 X |
| 4,156,034 | 5/1979 | Mukoh et al. | 526/317 |
| 4,250,241 | 2/1981 | Tsubuko et al. | 430/114 |
| 4,572,885 | 2/1986 | Sato et al. | 430/109 X |
| 4,814,251 | 3/1989 | Igeo | 430/115 |
| 5,019,477 | 5/1991 | Felder | 430/115 |
| 5,055,370 | 10/1991 | Suzuki et al. | 430/114 |
| 5,116,705 | 5/1992 | Materazzi | 430/45 |

FOREIGN PATENT DOCUMENTS

| | | | |
|---|---|---|---|
| 50065 | 2/1989 | Japan | 430/114 |
| 225370 | 10/1991 | Japan | 430/114 |

*Primary Examiner*—Roland Martin
*Attorney, Agent, or Firm*—John A. Brady

[57] ABSTRACT

A liquid toner for electrostatic imaging having 65–90 percent by weight of solids of terpolymer of about in the weight ratio of about 60/33/7 of styrene, n-butyl acrylate and methacrylic acid, respectively; 10–30 percent by weight of solid of pigment, an ionic or zwitterionic charge director, 1–5 percent by weight aluminum tristearate, and the remainder mineral oil as a vehicle.

8 Claims, No Drawings

LIQUID ELECTROSTATIC TONERS WITH TERPOLYMER RESIN

TECHNICAL FIELD

This invention relates to electrophotographic imaging with liquid developers and more specifically to the composition of a liquid developer having a resin binder component.

BACKGROUND OF THE INVENTION

It is known that a latent electrostatic image can be developed with toner particles dispersed in an insulating non-polar liquid. Such dispersed materials are known as liquid toners. A latent electrostatic image may be produced by providing a photoconductive layer with a uniform electrostatic charge and subsequently discharging the electrostatic charge by exposing it to a modulated beam of radiant energy. After the latent electrostatic image has been formed, the image is developed by colored toner particles dispersed in a non-polar liquid. The image may then be transferred to a receiver sheet.

Liquid toners comprise a thermoplastic resin and a dispersant non-polar liquid. Generally, a suitable colorant, such as a dye or a pigment, is also present. Since the formation of proper images depends on the difference of the charge between the liquid developer and the latent electrostatic image to be developed it has been found desirable to add a charge director compound and preferably other adjuvants which increase the magnitude of charge to the liquid toner comprising the thermoplastic resin, the non-polar liquid and the colorant.

The colored toner particles are dispersed in a non-polar liquid which generally has a high volume resistivity in excess of 10E+9 ohm-cm, a low dielectric constant, and a high vapor pressure. Once the image is printed on the output media (e.g. paper, transparency, etc.), due to high volatility of the liquid, the toner image on the output media dries readily. This dry image is resistant to abrasive and shear failure due to toner polymer returning back to its virgin resin properties.

Use of a high volatility liquid has several disadvantages. Both the printing mechanism and the printed output media become prime sources for contamination of indoor air leading to a variety of chemically induced ailments in humans. This has forced us to use low volatility liquids. The low volatility liquids do not leave the printed image readily and drastically impair the fixability (toner fusing to output media), leaving the image exposed to easy removal from the output media. The invention claimed herein separates this resin/liquid interaction, and shows the materials and a process designed such that even with the liquid present in the toner image the image is as tough as the virgin resin. The resins of this invention do not plasticize substantially in the liquid they are dispersed in. Typically, the resin families most commonly used in the experiments have been terpolymers of styrene/acrylate/methacrylic acid monomers.

U.S. Pat. No. 5,019,477 to Felder is to a liquid toner comparable to this invention. At column 4, beginning at line 42 it states that its toner solids are substantially insoluble in the carrier liquid. The resin polymers of this patent are not particularly similar to the terpolymer of this invention. This patent teaches a resin composition as a mixture of: i) copolymer of ethylene and acrylic acid (e.g. Nucrel) ii) copolymer of styrene (or vinyl toluene) and an acrylate. This invention differs by: i) its use of an acid in a terpolymer, ii) its use of very low volatility white oil, and iii) the absence of polyethylene.

U.S. Pat. No. 5,116,705 to Materozzi similarly discloses resins insoluble in the vehicle.

U.S. Pat. No. 3,668,127 to Machida et al is to a liquid toner having resin coated pigment in which the resin may be an acid containing terpolymer.

U.S. Pat. No. 3,890,240 to Hochberg teaches a composition of liquid toner developers which comprise: 1) volatile hydrocarbon solvent (e.g. Isopar brand), 2) dissolved terpolymer of vinyltoluene, butyl methacrylate, lauryl methacrylate, 3) carbon black & colorants, and 4) metal soap. This invention teaches a different liquid toner developer system as follows: 1) use of non volatile white oil (e.g. Marcol 82 brand), 2) Non swelling (non soluble) resin being a terpolymer of styrene, butyl acrylate, and methacrylic acid. The last component has no analog in U.S. Pat. No. 3,890,240.

In U.S. Pat. No. 4,156,034 to Mukoh et al, the liquid toner materials may be similar in that: compound (iii) col. 1.14, line 45 could be acrylic acid, and compound (iv) col. 2, line 65 could be butyl acrylate, but differs from our invention in that: a) compound (ii)is para alkylstyrene with a minimum alkyl chain length specified; while this invention employs styrene, b) this invention employs highly viscous white oil, c) and the examples of Mukoh et al never indicate compound (i) col. 2, line 16 to be a direct acid.

U.S. Pat. No. 4,814,251 to Igoe discloses liquid toners comprising of: i) vinyl toluene acrylic terpolymer (3 to 7 percent wt.) ii) acrylic copolymer (5 to 20% wt.) iii) pigment (10 to 18% wt.) and iv) high volatility isoparaffin solvent (60 to 80% w/w). This invention differs in that: i) this invention employs a very low volatility white oil, ii) this invention employs an acid together with styrene and butyl acrylate in a terpolymer, and iii) does not employ vinyl toluene.

Such resin modifications as investigated in inventions mentioned above may provide adequate function in highly volatile carrier liquid, but would not achieve the critically needed toner particle charging and image fixability in liquid of low volatility. Our toner formulations utilizing a highly viscous carrier liquid such as Marcol 82 brand mineral oil accomplish both.

SUMMARY OF THE INVENTION

The present invention teaches a liquid electrostatic developer comprising:

(a) a non-polar liquid have a kauri-butanol value of less than 30;

(b) thermoplastic resin particles comprising a styrene/n-butyl or n-longer aliphatic acrylate or methacrylate/acrylic or methacrylic acid terpolymer that has the acid functionality incorporated on the backbone, and blended with pigment(s) and other additives; and (c) an ionic or zwitterionic charge director compound.

A method for producing a liquid electrostatic developer according to the present invention comprises a process to blend the resin with the pigment and other additives followed by a particle size reduction process in the presence of a non-polar liquid. An ionic or zwitterionic charge director compound is mixed in.

It has been found that the toners employed in the present liquid electrostatic developers demonstrate higher mobility, higher charge, and increased fixability on print media.

Preferred Embodiment:

Toner Polymer Resin: 65–90 wt % of the solid toner

Monomer ratios in terpolymer resin: Styrene/n-butyl acrylate/methacrylic acid: 60/33/7

Charge Control Additive: Aluminum tristearate: 1–5 wt %

Pigment Loading: 10–30 wt %

Charge Director: TLA1605 (by Texaco) at 100–200 mg/g of solid toner+1 mg/g of carrier liquid Carrier Liquid: Marcol 82

Working Fluid Concentration: 8 to 15 wt % solids in carrier liquid.

DETAILED DESCRIPTION OF THE INVENTION

The inventors have found that the liquid electrostatic developers of the present invention demonstrate a high mobility, a high charge to mass ratio, and increased fixability of toner image on the media it is printed on. The characteristics these toners provide are achieved by tailoring a thermoplastic resin such that it swells only slightly in the toner liquid and has high acid content by incorporating the acid functionality in the backbone of the resin.

The reduced compatibility of the resin with the carrier liquid assures reduced or no softening of the resin due to solubilization or swelling. This aids in producing an image that has less liquid present in the image on the output media. With reduced oil in the toner image and with a thermoplastic resin that is not softened by the liquid, the image is more permanently fixed. The acid functionality of the toner particles is absolutely necessary for the charge director compound to impart charge.

The present liquid electrostatic developer is a dispersion comprising thermoplastic resin particles, ionic or zwitterionic charge director compounds, and optionally colorants and other adjuvants, in a non-polar liquid having a kauri-butanol value of less than 30. The toner solids of the present invention are substantially insoluble in the carrier liquid, and solubilizing action is not necessary.

The thermoplastic resin particles employed in the liquid electrostatic developer of the present invention comprise of a styrene/n-butyl acrylate/methacrylic acid terpolymer. The preferred monomer ratio in the terpolymer is: styrene, between 50 to 80%; n-butyl acrylate, between 15 to 40%; and methacrylic acid, between 2 and 15%; all by weight. The terpolymers are produced by Polytribo, Inc. Philadelphia, Pa. They are referred to herein as 'PBR' resins. 'PBR' and 'ACRYBASE' are trademarks of Polytribo, Inc. The PBR resins have a melt index value ranging from 1 to 30 (grams/10min. at 150 C. using 2160 gram load), and have a molecular weight of 10,000 to 100,000 with gel content ranging from 0 to 80 percent by weight. The acrylic/methacrylic acid is added between 2 and 10% as a monomer which is reacted in the polymer backbone. These terpolymers have an acid number between 10 and 80, and preferably between 40 and 50. The polymers range from 50 C to 80 C in glass transition temperature. The temperature at which a layer of toner particles form a contiguous film such that removal of the toner from a test surface is complete is called the film temperature. The film temperature of toners made with these polymers should be between 75 C and 130 C.

The thermoplastic resin particles of the present developers, should have median (using volume averaged statistics) particle size from about 0.5 to 30 microns, preferably about 1.0 to 10 microns, as measured by a centrifugal particle sizer. The toner particles can be described as three dimensional aggregates. The non-polar liquid having a kauri-butanol value of less than 30 employed as a dispersant in the present invention is preferably a white mineral oil of low vapor pressure, high boiling point, high flash point, and much higher in viscosity than the aliphatic hydrocarbon trademarked as Isopars (manufactured by Exxon Corp.). An aliphatic hydrocarbon liquid would work the same as the white oils in the present developer, but due to its high volatility, it would not necessitate the use of PBR resins to obtain high toner image fixability.

The white oils are odorless and are highly purified. All of the non-polar liquids for use in the present invention should have an electrical volume resistivity in excess of $10^9$ ohms/cm and a dielectric constant below 3.0. Moreover, the vapor pressure at 25 C should be less than 10 torr.

The preferred white oils are: Superla 9NF (brand name product of Amoco), Marcol 82 (brand name product of Esso), and Drakeol 10 (brand name product of Pennreco). The typical properties of these oils are:

Viscosity: 10–20 cSt,

Vapor Pressure: 10 micro g per liter,

Colorless and odorless,

Boiling Point: over 250 degree C, and

Flash Point: over 180 degrees C.

The amount of the non-polar liquid employed in the developer of the present invention is about 70–99.9, and preferably 80–95, percent by weight of the total toner dispersion. The total solids content of the present developer is 0.1 to 30 percent by weight, preferably 5 to 20 percent and more preferably, 8 to 15 percent by weight.

Appropriate ionic or zwitterionic charge director compound employed in the present invention include those which are soluble in the non-polar liquid. For example, negative charge directors, such as lecithin, oil-soluble petroleum sulfonate, and alkenyl succinimides may be used. The charge director compounds may be used in amounts of from 1 to 1,000 parts per thousand, and preferably about 100 to 300 parts per thousand, of the total amount of solids contained in the developer (i.e., based on total toner solids).

The liquid electrostatic developer of the present invention may optionally contain a colorant dispersed in the resin particles. Colorants, such as pigments or dyes and combinations thereof, are preferably present to render the latent image visible.

The colorant may be present in the developer in an amount of from about 0.1 to about 40 percent, and preferably from about 5 to 30 percent by weight based on the total weight of solids contained in the developer. The amount of colorant used may vary depending on the use of the developer.

Examples of pigments which may be used in the present developers are set forth below.

| Pigment Brand Name | Manufacturer | Color |
|---|---|---|
| Mobay YH5778 | Mobay | Yellow 74 |
| Sun Yellow | Sun | Yellow 13 |
| Mobay YH5778 | Mobay | Yellow 74 |
| Arylide Yellow 272-4608 | Sun | Yellow 74 |
| Sunbrite Yellow 275-0049 | Sun | Yellow 13 |
| Rubin Red 210-0707 | Sun | Red 57:1 |

-continued

| Pigment Brand Name | Manufacturer | Color |
|---|---|---|
| Quinacridone Violet 228-1119 | Sun | Violet 19 |
| Phthalocyanine Blue 249-1284 | Sun | Blue 15:3 |
| Mogul L | Cabot | Black, Cl |
| Sterling NS Black | Cabot | Black 7 |
| Quindo Magenta | Mobay | Red 122 |
| Permanent rubin F6B | Hoechst | Red 184 |
| Heliogen Blue K7090 | BASF | Blue 15:3 |
| Indofast Violet | Ciba-Geigy | Violet 19 |

In order to increase the toner charge and accordingly, increase the mobility and transfer latitude of the toners, charge adjuvant agents may also be dispersed in the resin particles. For examples negative charge adjuvants, such as metallic soaps (e.g. aluminum or magnesium stearate or octoate) and fine particle size oxides (such as the oxides of silica, alumina, titania, etc.) are added in the case of producing a developer containing negatively chargeable resin particles, and positive charge adjuvants, such as para-toluene sulfonic acid, and polyphosphoric acid, are added when producing a developer containing positively chargeable resin particles. The charge adjuvants are added to the present developer in an amount of from about 0.1 to 3 percent of the total weight of solids contained in the developer.

The present liquid electrostatic developer may be produced as follows: Blend the charge adjuvants and pigments with the polymer at 140 C in a two roll mill until the pigments and charge adjuvants are ground to a desired level. Cool it to ambient temperature, chop it into small pieces, and grind into a fine powder. Add the fine powder to the non-polar liquid (carrier fluid) in an attritor to provide a dispersion of about 15–25 percent solids. This mixture is size reduced by ⅜" dia. steel shot at a temperature between 15 C and 60 C until the desired toner particle size is achieved. Additional carrier fluid may be added after the particle size reduction is completed to ease the removal of the dispersion from the attritor. The dispersion of toner particles is separated from the dispersion medium (steel shot) by any appropriate means known to those skilled in the art.

An ionic or zwitterionic charge director compound is then added to impart a positive or negative charge to the developer, as desired. The charge director compound may be added at any time during the process, but preferably is added after particle size reduction and separation.

In order to facilitate handling of the developer, the concentration of toner particles in the dispersion may be reduced by the further addition of non-polar liquid. The dilution is normally conducted to reduce the concentration of toner particles to between 5 and 15 percent by weight.

The blending of the pigments and charge adjuvants may be done by using a twin screw extruder, or any compounding equipment (e.g. heated two roll mill). The present developer liquid may be prepared in a suitable mixing or blending vessel, e.g. an attritor, a heated ball mill, or a heated vibratory mill. The grinding media in the vessel may be steel shot (spherical or cylindrical shaped), or any other moving particulate media.

The present invention will now be illustrated by reference to the following specific, non-limiting examples. All amounts indicated are parts by weight unless otherwise specified.

All comparative examples were prepared as set forth below.

Step 1. Use a jacketed one gallon double planetary mixer (by Ross) to solubilize the thermo- plastic resins at 35 percent solids in carrier liquid at 170 degrees centigrade. The solubilization is done at a mixer setting of 2.5 for one hour and at 3.5 for the remainder of the hour. The solubilized compound is then removed from the double planetary mixer and allowed to cool.

Step 2. The compound is chopped into small pieces and fed through a chilled single screw grinder for further size reduction.

Step 3. The ground solubilized compound is added to a 1 S attritor (by Union Process) with colorants, aluminum stearate, and carrier liquid to obtain a working dispersion at 15% solids. The dispersion is attrited at 300 rpm and at 50 degrees centigrade for 16 hours. The particle size using a Shimadzu particle size analyzer is measured to assure the grind completion. Additional carrier liquid is added to dilute the dispersion to 5% solids to ease handling. A charge director compound, TLA1605 (polyisobutenyl succinimide compound by Texaco) or like compound is added at 100 mg per dry gram of solids.

COMPARATIVE EXAMPLE 1

212.8 g Surlyn 9020 ionomeric resin from Du Pont Co.

53.2 g Nucrel 599 acid resin of form of Surlyn 9020 from Du Pont Co.

61.1 g Mogul L carbon black 6.4 g Cyan Pigment BASF NBS6157D 4.7 g Mathe Aluminum Stearate 1912.5 g White Mineral Oil Marcol 82 from Esso

COMPARATIVE EXAMPLE 2

212.8 g Surlyn 9020 Resin of Example 1 above 53.2 g Nucrel 599 Resin of Example 1 above 66.6 g Cyan Pigment BT583D 4.7 g Mathe Aluminum Stearate 1912.5 g White Mineral Oil Marcol 82 from Esso

COMPARATIVE EXAMPLE 3

212.8 g Surlyn 9020 Resin of Example 1 above 53.2 g Nucrel 599 Resin of Example 1 above 66.6 g Quindo Red R6713

4.7 g Mathe Aluminum Stearate 1912.5 g White Mineral Oil Marcol 82 from Esso

COMPARATIVE EXAMPLE 4

212.8 g Surlyn 9020 Resin of Example 1 above 53.2 g Nucrel 599 Resin of Example I above 66.6 g Fanchon Yellow YH5778

4.7 g Mathe Aluminum Stearate 1912.5 g White Mineral Oil Marcol 82 from Esso

Examples 1 through 8 are prepared similar to comparative examples with these exceptions: The solubilization process is omitted; the thermoplastic resins of this invention do not plasticize and hence is not necessary. Instead, the colorants and aluminum stearate are blended with the thermoplastic resin at 140 degrees centigrade on a two roll mill until the additives are ground to a desired level. The milled compound is cooled and chopped into small pieces. Further toner processing steps are continued at step 2 of the comparative examples preparation.

EXAMPLE 1

266.0 g PBR 120 Resin from Polytribo, Inc.

61.1 g Mogul L carbon black 6.4 g Cyan Pigment BASF NBS6157D 4.7 g Mathe Aluminum Stearate 1912.5 g White Mineral Oil Marcol 82 from Esso

EXAMPLE 2

266.0 g PBR 120 Resin 6.4 g Cyan Pigment BT583D 4.7 g Mathe Aluminum Stearate 1912.5 g White Mineral Oil Marcol 82 from Esso

EXAMPLE 3

66.0 g PBR 120 Resin 6.4 g Quid Red R6713

4.7 g Mathe Aluminum Stearate 1912.5 g White Mineral Oil Marcol 82 from Esso

EXAMPLE 4

266.0 g PBR 120 Resin with 2% methacrylic acid 6.4 g Mobay Fanchon Yellow YH5778

4.7 g Mathe Aluminum Stearate 1912.5 g White Mineral Oil Marcol 82 from Esso

EXAMPLE 5

266.0 g PBR 126 Resin (PBR 120 with 7% methacrylic acid)

61.1 g Mogul L carbon black 6.4 g Cyan Pigment BASF NBS6157D 4.7 g Mathe Aluminum Stearate 1912.5 g White Mineral Oil Marcol 82 from Esso

EXAMPLE 6

266.0 g PBR D128 Resin (PBR 126 resin with 35% n-butyl acrylate)

61.1 g Mogul L carbon black 6.4 g Cyan Pigment BASF NBS6157D 4.7 g Mathe Aluminum Stearate 1912.5 g White Mineral Oil Marcol 82 from Esso

EXAMPLE 7

266.0 g PBR 120 Resin with 40% methyl methacrylate 61.1 g Mogul L carbon black 6.4g Cyan Pigment BASF NBS6157D 4.7g Mathe Aluminum Stearate 1912.5 g White Mineral Oil Marcol 82 from Esso

EXAMPLE 8

266.0 g PBR 120 Resin with 1% methacrylic acid 61.1 g Mogul L carbon black 6.4 g Cyan Pigment BASF NBS6157D 4.7 g Mathe Aluminum Stearate 1912.5 g White Mineral Oil Marcol 82 from Esso The PBR resins comprise the following monomers: styrene/acrylate (lauryl, n-butyl, etc.)/methacrylic acid. The monomer ratios of resin PBR120 is as follows: styrene (78%), n-butyl acrylate (20%), and methacrylic acid (2%). The PBR resin was modified by varying the monomer ratios and types and are mentioned in Examples 5 through 8.

Comparative Examples 1 through 4 were compared with Examples 1 through 8, with the results set forth in Table 1 below. The Q/M (charge to mass ratio) is determined by placing a known mass of toner between conductive parallel plates and subjecting the toner to a DC field for a specified period. The toner develops out on one of the plates and current flows through the circuit. The current is integrated, and from the data collected, charge to mass ratio is calculated. Generally, Q/M values around 50 microC/g signify an acceptable toner. The toner images were produced and fused for the evaluation of image quality. Images were evaluated on the basis of character edge definition, solid area coverage and its uniformity, and fine character printing. The image permanence was evaluated by producing and fusing a toner image on a xerographic paper, and abrading the image with many eraser strokes. The number of strokes needed for paper to show through the toned image is a measure of fixability. A higher number of strokes indicates a higher level of permanence. A rating of 7 strokes would be considered marginally acceptable.

TABLE I

| TONER | Q/M of toner particle | Image Quality | Image Permanence Number of strokes |
|---|---|---|---|
| Comparative Example 1 | 52 | Acceptable | 2 |
| Example 1 | 50 | Acceptable | 50+ |
| Comparative Example 2 | 50 | Acceptable | 3 |
| Example 2 | 45 | Acceptable | 50+ |
| Comparative Example 3 | 50 | Acceptable | 3 |
| Example 3 | 42 | Acceptable | 50+ |
| Comparative Example 4 | 52 | Acceptable | 3 |
| Example 4 | 47 | Acceptable | 50+ |
| Example 5 | 80 | Acceptable | 50+ |
| Example 6 | 40 | Acceptable | 50+ |
| Example 7 | 22 | Unacceptable | 50+ |
| Example 8 | 33 | Marginal | 50+ |

Variations within the spirit and scope of this invention can be anticipated.

We claim:

1. A liquid electrostatic toner comprising a mineral oil vehicle, a resin suspended in said vehicle, said resin being a terpolymer of the following three monomer types:

Styrene a)

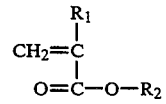

b)

where R1=H or CH3 and R2=saturated aliphatic hydrocarbon chain of $C_4H_9$ or greater,

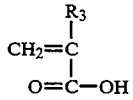

c)

where R3=H or CH3, a pigment embedded in said resin, and an ionic or zwitterionic charge director suspended in said vehicle, said toner being 98 to 85 percent by weight vehicle.

2. The liquid toner as in claim 1 also comprising aluminum tristearate as a charge control additive in an amount of 1 to 5 percent by weight of the solids of said toner and said pigment being in an amount of 10 to 30 percent by weight of the solid of said toner.

3. The liquid toner as in claim 1 wherein the terpolymer resin is as follows:

(a) is styrene, (b) is n-butyl acrylate, and (c) is methacrylic acid.

4. The liquid toner as in claim 3 also comprising aluminum tristearate as a charge control additive in an amount of 1 to 5 percent by weight of the solids of said toner and said pigment being in an amount of 10 to 30 percent by weight of solid of said toner.

5. A liquid toner as in claim 3 wherein the terpolymer resin is as follows: (a) 50 to 80 percent styrene, (b) 15 to 40 percent n-butyl acrylate and (c) 2 to 15 percent methacrylic acid.

6. The liquid toner as in claim 5 also comprising aluminum tristearate as a charge control additive in an amount of 1 to 5 percent by weight of the solids of said toner and said pigment being in an amount of 10 to 30 percent by weight of the solid of said toner.

7. The liquid toner as in claim 5 in which said terpolymer is composed of by weight about 60 percent styrene, about 33 percent n-butyl acrylate and 7 percent methacrylic acid.

8. The liquid toner as in claim 6 in which terpolymer is composed of by weight about 60 percent styrene, about 33 percent n-butyl acrylate and 7 percent methacrylic acid.

* * * * *